US010618608B2

(12) United States Patent
Leslie

(10) Patent No.: US 10,618,608 B2
(45) Date of Patent: Apr. 14, 2020

(54) PERSONAL WATERCRAFT STAND UP PADDLE BOARD IN A CATAMARAN CONFIGURATION

(71) Applicant: Leslie Lightcraft LTD Co., Friendswood, TX (US)

(72) Inventor: Christopher Leslie, Friendswood, TX (US)

(73) Assignee: Christopher Leslie, Friendswood, TX (US)

( * ) Notice: Subject to any disclaimer, the term of this patent is extended or adjusted under 35 U.S.C. 154(b) by 0 days.

(21) Appl. No.: 16/278,481

(22) Filed: Feb. 18, 2019

(65) Prior Publication Data

US 2019/0256175 A1 Aug. 22, 2019

Related U.S. Application Data

(60) Provisional application No. 62/632,202, filed on Feb. 19, 2018.

(51) Int. Cl.

| | |
|---|---|
| ***B63H 9/00*** | (2006.01) |
| ***B63B 35/81*** | (2006.01) |
| ***A63C 5/03*** | (2006.01) |
| ***B63B 32/55*** | (2020.01) |
| ***B63B 1/12*** | (2006.01) |
| ***B63B 32/57*** | (2020.01) |

(52) U.S. Cl.

CPC ..... *B63B 32/55* (2020.02); *B63B 1/121* (2013.01); *B63B 32/57* (2020.02)

(58) Field of Classification Search

CPC . B63B 35/79; B63B 35/7906; B63B 35/7909; B63B 35/7916; B63B 35/792; B63B 35/7926; B63B 2035/79; B63B 2035/7903; B63B 1/00; B63B 1/02; B63B 1/10; B63B 1/12; B63B 2001/123; B63B 1/121; B63B 2001/00; B63B 2001/02; B63B 2001/10; B63B 2001/12; B63B 2001/121

USPC .... 441/56.1, 61.1, 61.2, 61.22, 292; 114/65, 114/74, 79

See application file for complete search history.

(56) References Cited

U.S. PATENT DOCUMENTS

| | | | | |
|---|---|---|---|---|
| 3,585,664 A * | 6/1971 | Thompson | ..... | B63B 35/83 441/73 |
| 4,951,960 A * | 8/1990 | Sadler | ..... | A63C 5/031 280/607 |
| 9,751,599 B1 * | 9/2017 | Ebrahimi | ..... | B63B 35/7916 |

* cited by examiner

*Primary Examiner* — Daniel V Venne
(74) *Attorney, Agent, or Firm* — Darryl Edwin Scott

(57) ABSTRACT

A deck coupled to a paddle board having a base having a longitudinal axis, an axial axis substantially perpendicular to the longitudinal axis. A base length that is substantially in line with longitudinal axis, a paddle board width that is substantially in line with the axial axis. A bow side having a hull for displacing the water, a stern side, a port side, and a starboard side. A first rung integrally coupled to the port side, the first rung having a first rung bow side, a first rung stern side, and a first rung base positioned between the first rung bow side and the first rung stern side. A second rung integrally coupled to the starboard side, the second rung having a second rung bow side, a second rung stern side, and a second rung base positioned between the second rung bow side and the second rung stern side.

20 Claims, 4 Drawing Sheets

PERSONAL WATERCRAFT STAND UP PADDLE BOARD IN A CATAMARAN CONFIGURATION

BACKGROUND

Personal watercraft, stand-up paddle boards typically have elongated oval shapes and can have a length from nine feet to twelve feet from the bow to the stern. An individual who uses the paddle board will stand on top of the paddle board in a location that balances the individual with the board on the water. The individual's range of balance within the paddle board's center of gravity is constrained within its limited area existing directly above the centerline of the board running from the front to the back and directly beneath the center of the individual. If the individual moves away from that centerline in the direction of the starboard or port side, this causes instability which may result in the individual falling off the paddle board. Expanding the center of gravity of the paddle board is a challenge.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Personal watercraft, stand-up paddle boards typically have elongated oval shapes and can have a length from nine feet to twelve feet from the bow to the stern. An individual who uses the paddle board will stand on top of the paddle board in a location that balances the individual with the board on the water. The individual's range of balance within the paddle board's center of gravity is constrained within its limited area existing directly above the centerline of the board running from the front to the back and directly beneath the center of the individual. If the individual moves away from that centerline in the direction of the starboard or port side, this causes instability which may result in the individual falling off the paddle board.

The embodiments described herein expands the paddle board's limited range of balance and center of gravity such that an individual has a greater range of stability and thus a lower chance of falling off the paddle board. For example, by moving the center of buoyancy attributes away from the centerline and off to the starboard and port sides of the board using rungs (e.g., pontoons, catamaran), the center of gravity expands directly underneath the person out towards the starboard and port side. This expands the center of gravity which gives the person a larger platform to operate in.

In addition, other embodiments described herein allows the paddle board in a catamaran configuration to have a higher carrying weight capacity. For example, the paddle board described below will be able to hold up to 347 pounds without significant impact to the performance of the paddle board. Another aspect of the paddle board describe herein is its buoyancy and stability characteristics. An individual will be able to step down onto the body of the paddle board while the paddle board is moored to a deck using mooring cleats.

Figure 1:
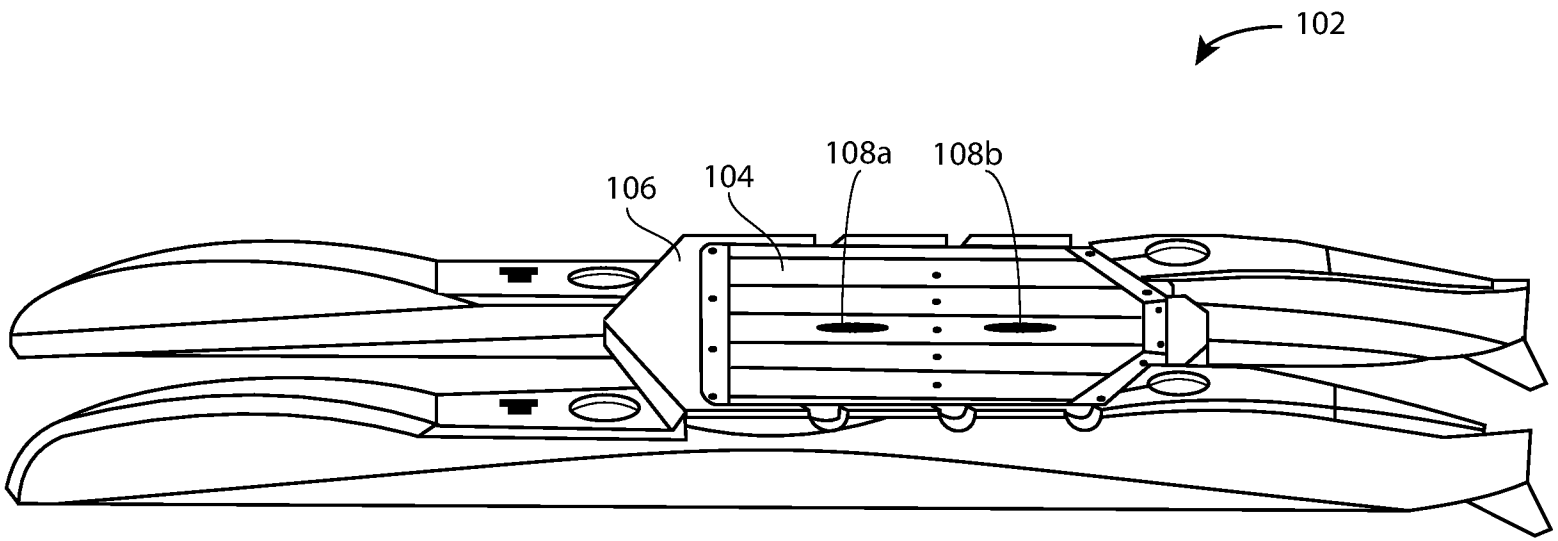
FIG. 1 is a perspective view of a paddle board in a catamaran configuration.

FIG. 1 is a perspective view of a paddle board in a catamaran configuration. A paddle board 102 in a catamaran configuration allows an individual (not shown) to have a larger center of gravity (i.e., surface area) to operate in when using the paddle board 102. The catamaran configuration expands the center of gravity of the paddle board 102 which reduces the chances the paddle board 102 will rotate from its center of gravity and causing the individual to fall off the paddle board 102. The paddle board 102 may be made of polyethylene plastic, fiberglass, epoxy, carbon fiber, or other similar material.

The paddle board 102 may include a deck 104. The paddle board 102 may include a paddle board base 106. The deck 104 may be coupled to the paddle board base 106 as a separate removable piece or may be integrated into the paddle board base 106 as one piece. In one or more embodiments, the paddle board base includes the deck 104. The deck 104 may be made from the same material as the paddle board 102 (i.e., polyethylene plastic, fiberglass, epoxy, carbon fiber, or other similar material). In one or more embodiments, the deck 104 is made from a woodgrain non-skid material or other similar material. The paddle board 102 may be transported using transporting grooves 108*a-b* located on the deck 104. Although FIG. 1 shows two transporting grooves (i.e., transporting grooves 108*a* and 108*b*) it is not to be interpreted as limiting the deck 104 to having only two transporting grooves 108*a-b* but the deck 104 may include a greater or lesser number of transporting grooves 108.

Figure 2:
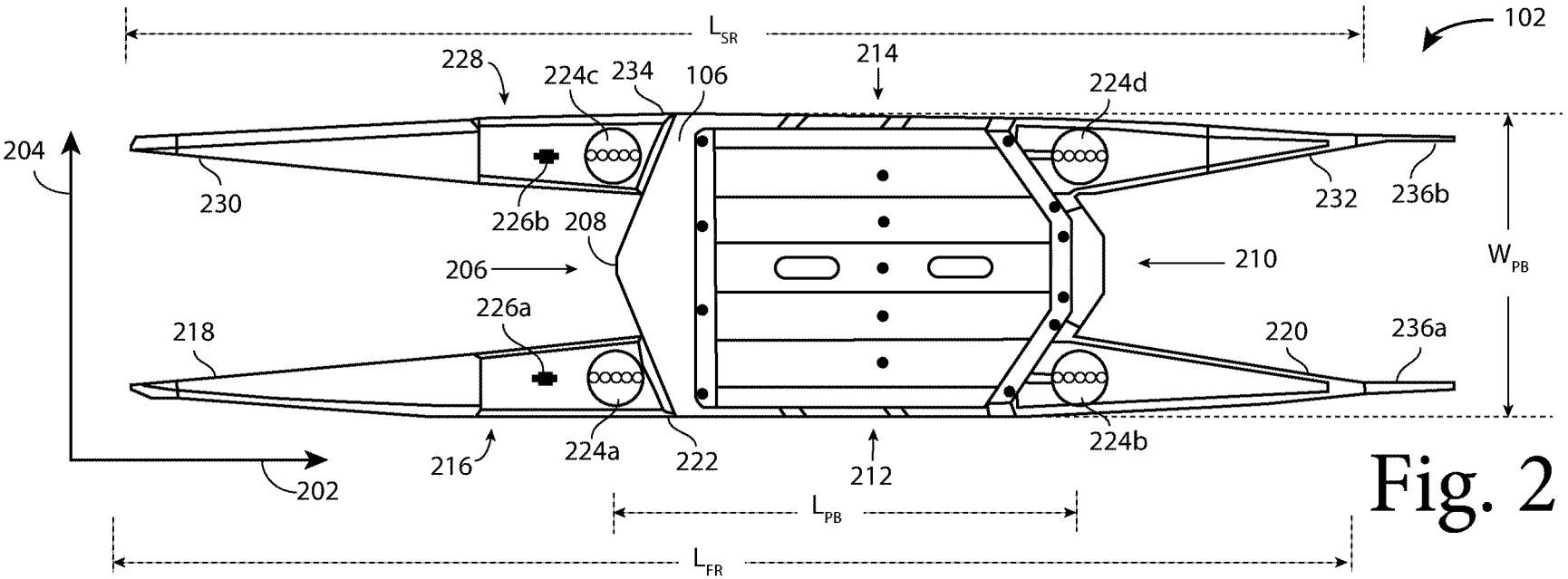
FIG. 2 is an aerial view of a paddle board in a catamaran configuration with retractable skegs.

FIG. 2 is an aerial view of a paddle board in a catamaran configuration. In one or more embodiments, the paddle board 102 has a longitudinal axis 202 and an axial axis 204 substantially perpendicular (i.e., within 1, 5, or 10 degrees) to the longitudinal axis 202. The paddle board base 106 may have a paddle board base length $L_{PB}$ between five feet and three and a half feet (i.e., 1.52 meters and 1.06 meters). In one or more embodiments, the paddle board length $L_{PB}$ is substantially in line with longitudinal axis 202 (i.e. within 1, 5 or 10 degrees). The paddle bard base 106 may have a paddle board base width $W_{PB}$ between four and a half feet and two feet (i.e., 1.4 meters and 0.61 meters). In one or more embodiments, the paddle board base width $W_{PB}$ is substantially in line (i.e., within 1, 5, or 10 degrees) with the axial axis 204.

In one or more embodiments, the paddle board 102 includes a leading edge bow side 206. The bow side 206 is the front of the paddle board 102. That is, when the individual (not shown) is standing on the paddle board 102 in the correct position (i.e., facing in the direction of the bow side 206), the bow side 206 will be towards the front of the individual (not shown) and in visual site of the individual. Although the paddle board 102 can move forward and backwards, the paddle board 102 is configured to move in the direction of the bow side 206.

Further, the paddle board 102 has a hull 208 integrally coupled to the bow side 206 of the paddle board 102. The hull 208 is used to displace the water when the paddle board 102 is paddled through the water. Displacing the water allows the paddle board 102 to travel through the water with greater ease. The hull 208 may be configured in different variations. For example, the hull 208 may have a flat bottom hull design (not shown), a round-bottom hull design (not shown), or a v-shaped hull design (not shown) or any variation thereof.

Similar to a vessel, the paddle board 102 includes a stern side 210. The stern side 210 is the back of the paddle board 102. That is, when the individual (not shown) is standing on the paddle board 102 in the correct position (i.e., facing in the direction of the bow side 206), the stern side 210 will be towards the back of the individual (not shown) and not in visual site of the Individual (not shown). Further, in one or more embodiments, the paddle board 102 includes a port side 212. The port side 212 is the left of the paddle boat 102. That is, when the individual (not shown) is standing on the paddle board 102 in the correct position (i.e., facing in the direction of the bow side 206), the port side 212 will be towards the left of the individual (not shown). Lastly, in one or more embodiments, the paddle board 102 includes a starboard side 214. The star board side 214 is right of the paddle board 102. That is, when the individual (not shown) is standing on the paddle board 102 in the correct position (i.e., facing in the direction of the bow side 206) the starboard side 214 will be on the right of the individual (not shown).

As illustrated in FIG. 2, the paddle board 102 may include a first rung 216 coupled to the port side 212 of the paddle board 102. In one or more embodiments, the first rung 216 is integrally coupled to the port side 212 of the paddle board 102. The first rung 216 may be positioned substantially in line (i.e., within 1, 5, or 10 degrees) with the longitudinal axis 202. In one or more embodiments, the first rung 216 is be made from polyethylene plastic, fiberglass, epoxy, carbon fiber, or other similar material. The first rung 216 may have a hollow core (not shown) which adds to the buoyancy of the paddle board 102.

In one or more embodiments, the first rung 216 has a first rung length $L_{FR}$ between fourteen and a half feet and seven feet (i.e., 4.4 meters and 2.1 meters). In one or more embodiments, the first rung 216 has a first rung length $L_{FR}$ that is greater than the paddle board base length $L_{PB}$.

The first rung 216 may be one uniform piece or may be comprised of separate pieces. For example, the first rung 216 may have a first rung bow side 218. The first rung bow side 218 is positioned on the same side as the bow side 206 of the paddle board 102. That is, when the individual (not shown) is on the paddle board 102 in the correct position (i.e., facing in the direction of the bow side 206) the individual has visual site of the first rung bow side 218. Further, the first rung 216 may have a first rung stern side 220. The first rung stern side 220 is positioned on the same side as the stern side 210 of the paddle board 102. That is, when the individual (not shown) is on the paddle board 102 in the correct position (i.e., facing in the direction of the bow side 206), the individual cannot see the first rung stern side 220.

In one or more embodiments, the first rung 216 includes a first rung base 222 coupled and positioned between the first rung bow side 218 and the first rung stern side 220. The first rung base 222 may be integrally coupled to the first rung bow side 218 and the first rung stern side 220 such that is one uniform piece. The first rung base 222 may include at least one stowage port 224*a-b*. The stowage ports 224*a-b* are hatches that give access to a chasm located in the body of the paddle board 102. Although FIG. 2 shows two stowage ports 224*a-b* on the first rung base 222, it is not to be interpreted as to only having two stowage ports 224*a-b*, but may have a greater of lesser number of stowage ports 224*a-b*. In addition, the first rung base 222 may include at least one mooring cleat 226*a*. The mooring cleat 226*a* is used to serve as an anchoring apparatus for tying a rope around so as to anchor the paddle boat 102 to another object (not shown).

As illustrated in FIG. 2, the paddle board 102 may include a second rung 228 coupled to the starboard side 214 of the paddle board 102. In one or more embodiments, the second rung 228 is integrally coupled to the starboard side 214 of the paddle board 102. The second rung 228 may be positioned substantially in line (i.e., within 1, 5, or 10 degrees) with the longitudinal axis 202. In one or more embodiments, the second rung 228 may be made from polyethylene plastic, fiberglass, epoxy, carbon fiber, or other similar material. The second rung 228 may have a hollow core (not shown) which adds to the buoyancy of the paddle board 102.

In one or more embodiments, the second rung 228 has a second rung length $L_{SR}$ between fourteen and a half feet and seven feet (i.e., 4.4 meters and 2.1 meters). In one or more embodiments, the second rung 228 has a second rung length $L_{SR}$ that is greater than the paddle board base length $L_{PB}$.

The second rung 228 may be one uniform piece or may be comprised of separate components.

For example, the second rung 228 may have a second rung bow side 230. The second rung bow side 230 is positioned on the same side as the bow side 206 of the paddle board 102. That is, when the individual (not shown) is on the paddle board 102 in the correct position (i.e., facing in the direction of the bow side 206) the individual has visual site of the second rung bow side 230. Further, the second rung 228 may have a second rung stern side 232. The second rung stern side 232 is positioned on the same side as the stern side 210 of the paddle board 102. That is, when the individual (not shown) is on the paddle board 102 in the correct position (i.e., facing in the direction of the bow side 206), the individual cannot see the second rung stern side 232.

In one or more embodiments, the second rung 228 includes a second rung base 234 coupled and positioned between the second rung bow side 230 and the second rung stern side 232. The second rung base 234 may be integrally coupled to the second rung bow side 230 and the second rung stern side 232 such that is one uniform piece. The second rung base 234 may include at least one stowage port 224*c-d*. The stowage ports 224*c-d* may be used to hold or carry items on the paddle board 102. Although FIG. 2 shows two stowage ports 224*c-d* on the second rung base 234, it is not to be interpreted as to only having two stowage ports 224*c-d*, but may have a greater of lesser number of stowage ports 224*c-d*. In addition, the second rung base 234 may include at least one mooring cleat 226*b*. The mooring cleat 226*b* is used to serve as anchoring apparatus for tying a rope around so as to anchor the paddle boat 102 to another object (not shown).

As illustrated in FIG. 2, the first rung stern side 220 and the second rung stern side 232 may include retractable skegs 236*a-b*. The retractable skegs 236*a-b* are coupled to the second rung stern 232 and the first rung stern 220 respectively. The retractable skegs 236*a-b* are similar to rudders on a boat or a ship. The retractable skegs 236*a-b* able the paddle board 102 to travel in a straight line.

Figure 3:
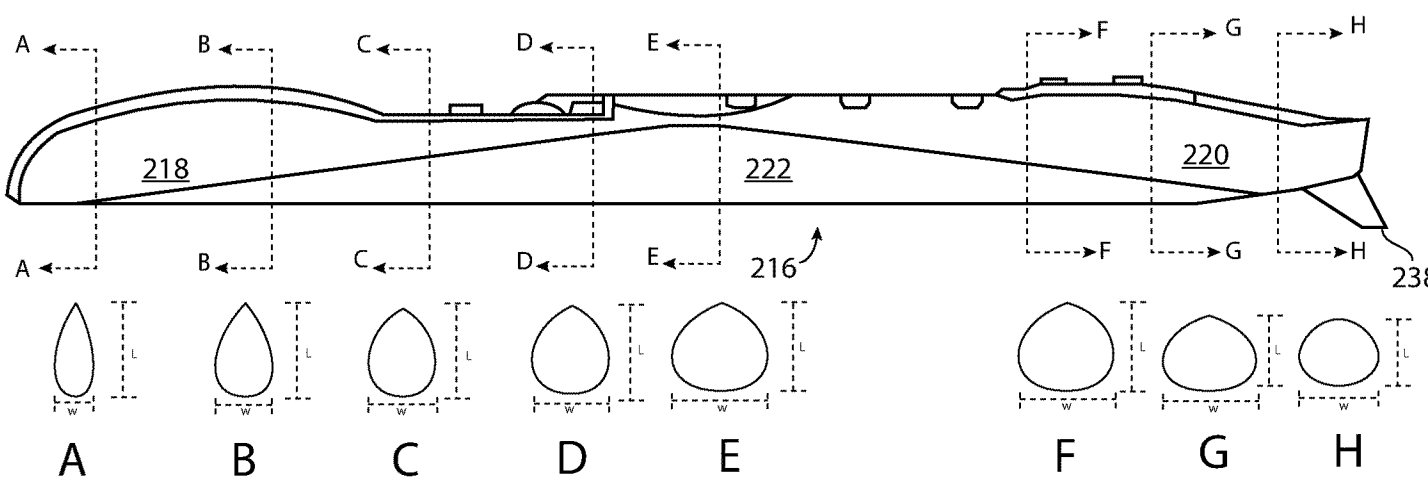
FIG. 3 is a plan view of a paddle board in a catamaran configuration with stabilizer fins.

FIG. 3 is a plan view of a paddle board in a catamaran configuration. As illustrated in FIG. 3, the first rung 216 may have varying dimensions starting from the first rung bow side 218 and ending to the first rung stern side 220. Note, any reference to the first rung 216 as it relates to the varying dimensions will also apply to the second rung 228. Any mention of the varying dimensions of the first rung 216 is to be interpreted as applying to the second rung 228. Further, the varying dimensions in the first rung 216 and the second rung 228 gives the first rung 216 and second rung 228 hydrodynamic characteristics which allows the paddle board 102 to travel through the water with greater ease.

The first rung 216 may form a "tear-drop" shape with the base of the "tear-drop" (i.e., largest width portion of the "tear-drop" shape) being the portion that is submerged in the water. For example, the first rung bow side 218 may have at least three different varying dimensions. The first dimension, which is illustrated by the cross-sectional dashed line labeled "A" may have a base width of at least four inches (i.e., 10.2 centimeters) and a height of at least eight inches (i.e., 203.2 centimeters). The second dimension, which is illustrated by the cross-sectional dashed line labeled "B" may have a base width of at least six inches (i.e., 15.24 centimeters) and a height of at least eight inches (i.e., 203.2 centimeters). The third dimension, which is illustrated as the cross-sectional dashed line labeled "C" may have a base width of at least eight inches (i.e., 203.2 centimeters) and a height of at least seven inches (i.e., 17.78 centimeters). Note, the first rung bow side 218 transitions smoothly from one dimension to the other (i.e., no jagged breaks from one dimension to the other dimension).

In one or more embodiments, the first rung base 222 may have at least two varying dimensions. For example, the fourth dimension which is illustrated by the cross-sectional dashed line labeled "D" may have a base width of nine inches (i.e., 22.86 centimeters) and a height of at least seven inches (i.e., 17.78 centimeters). The fifth dimension which is illustrated by the cross-sectional dashed line labeled "E" may have a base width of at least ten inches (i.e., 25.4 centimeters) and a height of at least seven inches (i.e., 17.78 centimeters). Note, the first rung base 222 transitions smoothly from one dimension to the other (i.e., no jagged breaks from one dimension to the other dimension).

In one or more embodiments, the first rung stern side 220 may have at least three varying dimensions. For example, the sixth dimension which is illustrated by the cross-sectional dashed line labeled "F" may have a base width of at least ten inches (i.e., 25.4 centimeters) and a height of at least seven inches (i.e., 17.78 centimeters). The seventh dimension which is illustrated by the cross-sectional dashed line labeled "G" may have a base width of at least ten inches (i.e., 25.4 centimeters) and a height of at least six inches (i.e., 15.24 centimeters). The eight dimensions which is illustrated by the cross-sectional dashed line labeled "H" may have a base width of at least 10 inches (i.e., 25.4 centimeters) and a height of at least five inches (i.e., 12.7 centimeters). Note, the first rung stern side 220 transitions smoothly from one dimension to the other (i.e., no jagged breaks from one dimension to the other dimension).

In one or more embodiments, the first rung stern side 220 and the second rung stern side 232 may include a stabilizing fin 238. Note, only one stabilizing fin 238 is shown for clarity. The stabilizing fin 238 is an alternative to the retractable skegs 236*a-b* described in connection to FIG. 2. The stabilizing fin 238 may be made from the same material as the paddle board 102.

Figure 4:
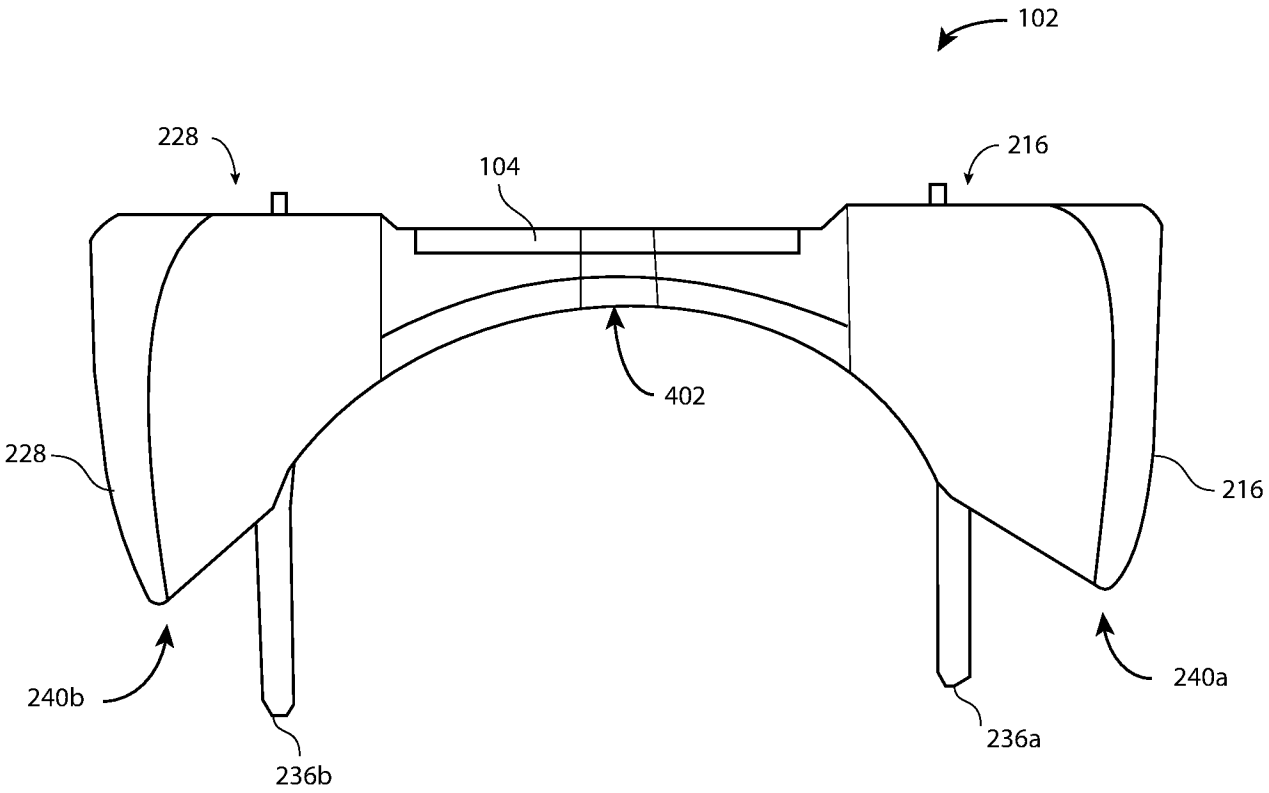
FIG. 4 is a frontal view of a paddle board in a catamaran configuration.

FIG. 4 is a frontal view of a paddle board in a catamaran configuration. As illustrated in FIG. 4, the paddle board base 106 has a bottom surface 402. The bottom surface 402 may form a concave shape that integrally merges into the first rung 216 and the second rung 228. In addition, the first rung 216 and second rung 238 may have a different design and dimensions as opposed to those described in connection to FIG. 3. For example, the bottom portion of the first rung 216 and the second rung 228 (indicated by the arrow labeled 240*a-b*) may form a "v" shape with the apex portion contacting the water. This "v" shape may run uniformly throughout the body of the first rung 216 and second rung 228.

Figure 5:
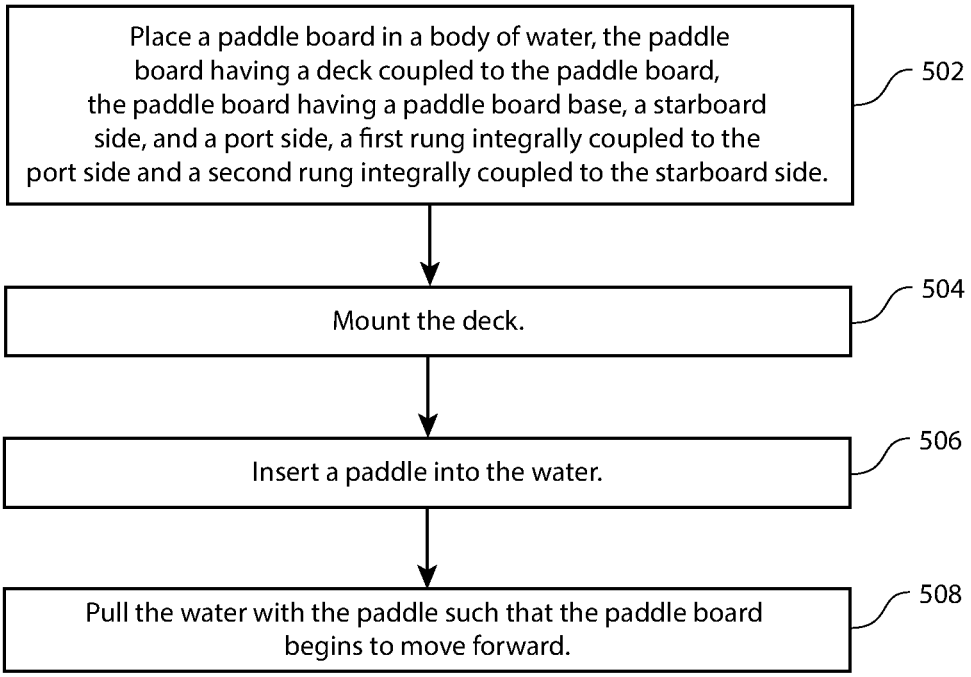
FIG. 5 is a flow chart showing the method of using a paddle board in a catamaran configuration.

FIG. 5 is a flow chart showing the method of using a paddle board in a catamaran configuration. The process includes placing a paddle board (such as paddle board 102) in a body of water, the paddle board having a deck (such as deck 104) coupled to the paddle board (such as paddle board 102), the paddle board (such as paddle board 102) has a paddle board base (such as paddle board base 106), a starboard side (such as starboard side 214), and a port side (such as port side 212), a first rung (such as first rung 216) integrally coupled to the port side (such as port side 212) and a second rung (such as second rung 228) integrally coupled to the starboard side (such as starboard side 214) (block 502). Mounting the deck (such as deck 104) (block 504). Inserting a paddle into the water (block 506). Pulling the water with the paddle such that the paddle board (such as paddle board 102) begins to move forward (block 508).

In one aspect an apparatus includes a deck coupled to a paddle board. The paddle board has a paddle board base. The paddle board base has a longitudinal axis and an axial axis substantially perpendicular to the longitudinal axis. The paddle board has paddle board base length $L_{PB}$ that is substantially in line with longitudinal axis and a paddle board base width $W_{PB}$ that is substantially in line with the axial axis. The paddle board base has a bow side having a hull for displacing the water, a stern side, a port side, and a starboard side. A first rung is integrally coupled to the port side and positioned substantially in line with the longitudinal axis. The first rung has a first rung length $L_{FR}>L_{PB}$, a first rung bow side, a first rung stern side, and a first rung base positioned between the first rung bow side and the first rung stern side. A second rung is integrally coupled to the starboard side. The second rung has a second rung length $L_{SR}>L_{PB}$, a second rung bow side, a second rung stern side, and a second rung base positioned between the second rung bow side and the second rung stern side.

Implementation may include one or more of the following. The deck may include a woodgrain non-skid deck. The deck may include at least one transporting groove. The first rung base may include at least one mooring cleat and at least one stowage port. The second rung base may include at least one mooring cleat and at least one stowage port. The first rung stern side may include a retractable skeg. The second rung stern side may include a retractable skeg. The first rung length $L_{FR}$ is less than eleven and a half feet and greater than paddle board length $L_{PB}$. The second rung length $L_{SR}$ is less than eleven and a half feet and greater than the paddle board length $L_{PB}$. The paddle board base width $W_{PB}$ is less than four feet and greater than two feet.

In one aspect the method includes a person placing a paddle board in a body of water. A deck is coupled to the paddle board. The paddle board has a paddle board base. The paddle board base has a longitudinal axis and an axial axis substantially perpendicular to the longitudinal axis. The paddle board has a paddle board base length $L_{PB}$ that is substantially in line with longitudinal axis and a paddle board base width $W_{PB}$ that is substantially in line with the axial axis. The paddle board base has a bow side having a hull for displacing the water, a stern side, a port side, and a starboard side. A first rung is integrally coupled to the port side and positioned substantially in line with the longitudinal axis. The first rung has a first rung length $L_{FR}>L_{PB}$, a first rung bow side, a first rung stern side, and a first rung base positioned between the first rung bow side and the first rung stern side. A second rung is integrally coupled to the starboard side. The second rung has a second rung length $L_{SR}>L_{PB}$, a second rung bow side, a second rung stern side, and a second rung base positioned between the second rung bow side and the second rung stern side. The person mounts the deck. The person inserts a paddle into the water and pull the water with the paddle such that the paddle board begins to move forward.

Implementation may include one or more of the following. The deck may include a woodgrain non-skid deck. The deck may include at least one transporting groove. The first rung base may include at least one mooring cleat and at least one stowage port. The second rung base may include at least one mooring cleat and at least one stowage port. The first rung stern side may include a retractable skeg. The second rung stern side may include a retractable skeg. The first rung length $L_{FR}$ is less than eleven and a half feet and greater than paddle board length $L_{PB}$. The second rung length $L_{SR}$ is less than eleven and a half feet and greater than the paddle board length $L_{PB}$. The paddle board base width $W_{PB}$ is less than four feet and greater than two feet.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for paddle boarding comprising:
- a the paddle board having:
  - a paddle board base having:
    - a deck,
    - a longitudinal axis,
    - an axial axis substantially perpendicular to the longitudinal axis,
    - a paddle board base length $L_{PB}$ that is substantially in line with longitudinal axis,
    - a paddle board base width $W_{PB}$ that is substantially in line with the axial axis,
    - a bow side having a hull for displacing the water,
    - a stern side,
    - a port side, and
    - a starboard side;
  - a first rung integrally coupled to the port side and positioned substantially in line with the longitudinal axis, the first rung having:
    - a first rung length $L_{FR}>L_{PB}$,
    - a first rung bow side,
    - a first rung stern side, and
    - a first rung base positioned between the first rung bow side and the first rung stern side;
  - a second rung integrally coupled to the starboard side, the second rung having a second rung length $L_{SR}>L_{PB}$,
    - a second rung bow side,
    - a second rung stern side, and
    - a second rung base positioned between the second rung bow side and the second rung stern side.

2. The apparatus of claim 1 wherein the deck is a woodgrain non-skid deck.

3. The apparatus of claim 1 wherein the deck includes at least one transporting groove.

4. The apparatus of claim 1 wherein the first rung base includes at least one mooring cleat and at least one stowage port.

5. The apparatus of claim 1 wherein the second rung base includes at least one mooring cleat and at least one stowage port.

6. The apparatus of claim 1 wherein the first rung stern side includes a retractable skeg.

7. The apparatus of claim 1 wherein the second rung stern side includes a retractable skeg.

8. The apparatus of claim 1 wherein the $L_{FR}<14$ ft. $>L_{PB}$.

9. The apparatus of claim 1 wherein the $L_{SR}<14$ ft. $>L_{PB}$.

10. The apparatus of claim 1 wherein the $W_{PB}<5$ ft. $>3.5$ ft.

11. A method for paddling on a board comprising:
- a person placing a paddle board in a body of water, the paddle board having:
  - a paddle board base having:
    - a deck,
    - a longitudinal axis,
    - an axial axis substantially perpendicular to the longitudinal axis,
    - a paddle board base length $L_{PB}$ that is substantially in line with longitudinal axis,
    - a paddle board base width $W_{PB}$ that is substantially in line with the axial axis,
    - a bow side having a hull for displacing the water,
    - a stern side,
    - a port side, and
    - a starboard side;
  - a first rung integrally coupled to the port side and positioned substantially in line with the longitudinal axis, the first rung having:
    - a first rung length $L_{FR}>L_{PB}$,
    - a first rung bow side,
    - a first rung stern side, and
    - a first rung base positioned between the first rung bow side and the first rung stern side;
  - a second rung integrally coupled to the starboard side, the second rung having a second rung length $L_{SR}>L_{PB}$,
    - a second rung bow side,
    - a second rung stern side, and a second rung base positioned between the second rung bow side and the second rung stern side;

the person mounting the deck;

the person inserting a paddle into the water; and the person pulling the water with the paddle such that the paddle board begins to move forward.

12. The apparatus of claim 11 wherein the deck is a woodgrain non-skid deck.

13. The apparatus of claim 11 wherein the deck includes at least one transporting groove.

14. The apparatus of claim 11 wherein the first rung base includes at least one mooring cleat and at least one stowage port.

15. The apparatus of claim 11 wherein the second rung base includes at least one mooring cleat and at least one stowage port.

16. The apparatus of claim 11 wherein the first rung stern side includes a retractable skeg.

17. The apparatus of claim 11 wherein the second rung stern side includes a retractable skeg.

18. The apparatus of claim 11 wherein the $L_{FR}$<14 ft. >$L_{PB}$.

19. The apparatus of claim 11 wherein the $L_{SR}$<14 ft. >$L_{PB}$.

20. The apparatus of claim 11 wherein the $W_{PB}$<5 ft. >3.5 ft.

* * * * *